US007647017B2

(12) United States Patent
Uehara et al.

(10) Patent No.: US 7,647,017 B2
(45) Date of Patent: Jan. 12, 2010

(54) FIXING DEVICE AND IMAGE-FORMING APPARATUS

(75) Inventors: Yasuhiro Uehara, Kanagawa (JP); Shigehiko Haseba, Kanagawa (JP); Motofumi Baba, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 194 days.

(21) Appl. No.: 11/878,421

(22) Filed: Jul. 24, 2007

(65) Prior Publication Data

US 2008/0124147 A1 May 29, 2008

(30) Foreign Application Priority Data

Nov. 24, 2006 (JP) ..... 2006-317244

(51) Int. Cl.
*G03G 15/20* (2006.01)

(52) U.S. Cl. ..... 399/333; 219/619; 399/329

(58) Field of Classification Search ..... 399/330, 399/333, 328, 329; 219/216, 619; 347/156
See application file for complete search history.

(56) References Cited

U.S. PATENT DOCUMENTS

RE38,810 E * 10/2005 Terada et al. ..... 399/328
2006/0029444 A1* 2/2006 Naito et al. ..... 399/329
2006/0127144 A1* 6/2006 Watanabe ..... 399/329
2008/0063445 A1 3/2008 Imai et al. ..... 399/333
2008/0131178 A1* 6/2008 Baba et al. ..... 399/328

FOREIGN PATENT DOCUMENTS

| | | |
|---|---|---|
| JP | 11-327331 | 11/1999 |
| JP | 2002-311745 | 10/2002 |
| JP | 2005-249958 | 9/2005 |
| JP | A 2006-047988 | 2/2006 |
| WO | WO 2006/011454 | 2/2006 |

* cited by examiner

*Primary Examiner*—Sophia S Chen
(74) *Attorney, Agent, or Firm*—Morgan, Lewis & Bockius LLP

(57) ABSTRACT

Fixing device includes a first cylindrical rotating member having an inner peripheral surface and an outer peripheral surface; a second rotating member which is brought into contact with the first rotating member; magnetic field generation units for generating a magnetic field, the magnetic field generation units being provided at a predetermined distance from the inner or outer peripheral surface of the first rotating member; and a heat generation member that generates heat by a magnetic field, the heat generation member being provided so as to be opposed to the magnetic field generation units across the first rotating member and to be in contact with the first rotating member, having a thickness larger than a skin depth, and containing a magnetic metal material.

14 Claims, 4 Drawing Sheets

FIXING DEVICE AND IMAGE-FORMING APPARATUS

CROSS-REFERENCE TO RELATED APPLICATION

This application claims priority under 35 USC 119 from Japanese Patent Application No. 2006-317244 filed Nov. 24, 2006.

BACKGROUND

1. Technical Field

The present invention relates to a fixing device and an image-forming apparatus.

2. Related Art

Fixing devices using an electromagnetic induction heating method have been proposed. The electromagnetic induction heating method is a method according to which a magnetic field generated by an induction coil is applied to a rotating member having a conductive layer to generate an eddy current in the conductive layer so that the rotating member can directly generate heat.

This kind of fixing device using an electromagnetic induction heating method is proposed in, for example, Japanese Patent Application Laid-Open No. 2006-047988. The fixing device includes: an endless rotation member having a heat generation layer, and a guide member for guiding the rotation member, the guide member having a heat generation layer having a thickness of skin depth or less.

SUMMARY

According to an aspect of the present invention, there is provided a fixing device comprising: a first cylindrical rotating member having an inner peripheral surface and an outer peripheral surface; a second rotating member which is brought into contact with the first rotating member; magnetic field generation units for generating a magnetic field, the magnetic field generation units being provided at a predetermined distance from the inner or outer peripheral surface of the first rotating member; and a heat generation member which generates heat by the action of a magnetic field, the heat generation member being provided so as to be opposed to the magnetic field generation units across the first rotating member and to be in contact with the first rotating member, having a thickness larger than a skin depth, and containing a magnetic metal material.

DETAILED DESCRIPTION

Figure 1:
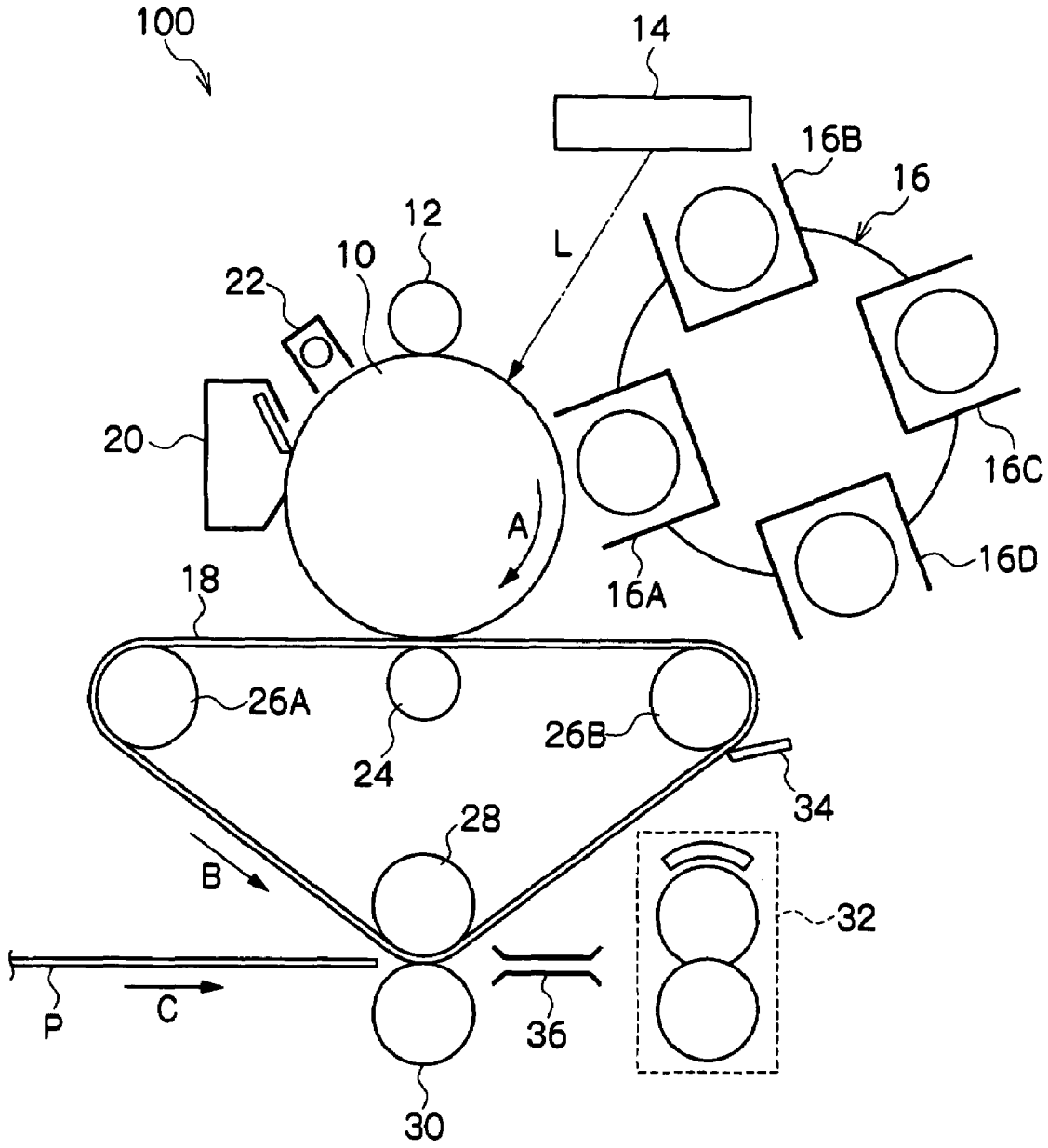
FIG. 1 is a schematic diagram which shows the structure of an image-forming apparatus according to an exemplary embodiment of the present invention.

The invention includes the following embodiments.

<1> A fixing device comprising: a first cylindrical rotating member having an inner peripheral surface and an outer peripheral surface; a second rotating member that contacts the first rotating member; a magnetic field generation unit that generates a magnetic field, the magnetic field generation unit being provided at a predetermined distance from the inner or outer peripheral surface of the first rotating member; and a heat generation member which generates heat by the action of a magnetic field, the heat generation member being provided so as to oppose the magnetic field generation unit across the first rotating member and to contact the first rotating member, and having a thickness larger than skin depth and containing a magnetic metal material.

<2> The fixing device according to item <1>, wherein the skin depth is a skin depth δ (m) represented by the following formula: $\delta=503(\rho/(f\times\mu r))^{1/2}$ wherein f is a frequency f (Hz) of a magnetic excitation circuit, μr is a relative magnetic permeability, and ρ is a specific resistance (Ωm).

<3> The fixing device according to item <1>, wherein the magnetic metal material has a relative magnetic permeability of about 100 or more.

<4> The fixing device according to item <1>, wherein the magnetic metal material is a temperature-sensitive magnetic metal material having a Curie point.

<5> The fixing device according to item <4>, wherein the Curie point is within a range from a preset temperature of the first rotating member to a heat-resistant temperature of the first-rotating member.

<6> The fixing device according to item <4>, wherein the Curie point is within a range of from about 170 to about 250° C.

<7> The fixing device according to item <4>, wherein the temperature-sensitive magnetic material is an Ni—Fe-based magnetic shunt alloy or an Ni—Cr—Fe-based magnetic shunt alloy.

<8> The fixing device according to item <1>, further comprising a driving force transmission member for transmitting a rotation driving force to the first rotating member, the driving force transmission member being provided at least at one end of the first rotating member in an axial direction thereof.

<9> The fixing device according to item <1>, wherein the first rotating member is configured by an endless belt, the magnetic field generation unit is provided at a predetermined distance from the outer peripheral surface of the first rotating member, and the heat generation member allows the first rotating member to maintain its cylindrical shape and is in substantial non-pressure contact with the inner peripheral surface of the first rotating member.

<10> The fixing device according to item <1>, wherein the first rotating member has a heat generation layer containing a non-magnetic metal material.

<11> The fixing device according to item <1>, further comprising a support member for supporting the heat generation member at ends thereof.

<12> A fixing device comprising: a first cylindrical rotating member having an inner peripheral surface and an outer peripheral surface; a second rotating member that contacts the first rotating member; a magnetic field generation unit that generates a magnetic field, the magnetic field generation unit being provided at a predetermined distance from the inner or outer peripheral surface of the first rotating member; a heat generation member which generates heat by the action of a magnetic field, the heat generation member being provided so as to oppose the magnetic field generation unit across the first rotating member and to contact the first rotating member, and having a thickness larger than a skin depth and containing a magnetic metal material; and a non-magnetic metal member containing a non-magnetic metal material, the non-magnetic metal member being provided at the inside of the first rotating member so as to oppose the magnetic field generation unit across the first rotating member and the heat generation member without contacting the heat generation member.

<13> The fixing device according to item <12>, wherein the non-magnetic metal material is a metal selected from the group consisting of copper, aluminum and gold.

<14> An image-forming apparatus comprising: a latent image supporter having a surface; a latent image forming unit for forming a latent image on the surface of the latent image supporter; a developing unit for developing the latent image into a visible image with an electrophotographic developer; a transfer unit for transferring the developed visible image onto a transfer medium; and a fixing unit for fixing the visible image that has been transferred onto the transfer medium, wherein the fixing units is the fixing device according to item <1>.

<15> An image-forming apparatus comprising: a latent image supporter having a surface; a latent image forming unit for forming a latent image on the surface of the latent image supporter; a developing unit for developing the latent image into a visible image with an electrophotographic developer; a transfer unit for transferring the developed visible image onto a transfer medium; and a fixing unit for fixing the visible image that has been transferred onto the transfer medium, wherein the fixing units is the fixing device according to item <9>.

<16> An image-forming apparatus comprising: a latent image supporter having a surface; a latent image forming unit for forming a latent image on the surface of the latent image supporter; a developing unit for developing the latent image into a visible image with an electrophotographic developer; a transfer unit for transferring the developed visible image onto a transfer medium; and a fixing unit for fixing the visible image that has been transferred onto the transfer medium, wherein the fixing units is the fixing device according to item <12>.

The exemplary embodiment of the invention according to the above item <1> provides a fixing device including: a first cylindrical rotating member having an inner peripheral surface and an outer peripheral surface; a second rotating member which is brought into contact with the first rotating member; magnetic field generation units for generating a magnetic field, the magnetic field generation units being provided at a predetermined distance from the inner or outer peripheral surface of the first rotating member; and a heat generation member which generates heat by the action of a magnetic field, the heat generation member being provided so as to be opposed to the magnetic field generation units across the first rotating member and to be in contact with the first rotating member, having a thickness larger than a skin depth, and containing a magnetic metal material.

The "skin depth" used herein refers to an absorption depth of an electromagnetic wave used for electromagnetic induction. The intensity of the electromagnetic wave in a portion deeper than the skin depth becomes 1/e or less. Conversely, almost all the energy is absorbed before reaching the skin depth.

The exemplary embodiment of the invention according to the item <4> provides the fixing device as set forth in the item <1>, wherein the magnetic metal material contains a temperature-sensitive magnetic metal material having a Curie point.

The "Curie point" used herein is also called "Curie temperature", and refers to a temperature at or above which a magnetic material loses its magnetic force, that is, becomes non-magnetic. Therefore, the temperature-sensitive magnetic metal material has magnetic properties at a temperature lower than a predetermined temperature (i.e., a Curie point) and therefore does not allow a magnetic flux (magnetic field) to penetrate it, but becomes non-magnetic at the predetermined temperature or higher and therefore allows a magnetic flux (magnetic field) to penetrate it.

The exemplary embodiment of the invention according to the item <5> provides the fixing device as set forth in the item <4>, wherein the Curie point is in a range of a preset temperature of the first rotating member to a heat-resistant temperature of the first rotating member. The "preset temperature of the first rotating member" used herein refers to a surface temperature of the first rotating member at the time of start of fixing, and the "heat-resistant temperature" refers to a maximum temperature at which the fixing belt can be continuously used without being thermally damaged.

The exemplary embodiment of the invention according to the item <8> provides the fixing device as set forth in the item <1>, further comprising a driving force transmission member for transmitting a rotation driving force to the first rotating member, the driving force transmission member being provided at least one of the both ends of the first rotating member in the axial direction thereof.

The exemplary embodiment of the invention according to the item <9> provides the fixing device as set forth in the item <1>, wherein the first rotating member is composed of an endless belt, the magnetic field generation units is provided at a predetermined distance from the outer peripheral surface of the first rotating member, and the heat generation member allows the first rotating member to maintain its cylindrical shape and is in substantial non-pressure contact with the inner peripheral surface of the first rotating member.

The phrase "is in substantial non-pressure contact with the inner peripheral surface of the first rotating member" used herein units that the heat generation member is in close contact with the endless belt without applying tension greater than necessary to the endless belt. More specifically, the phrase units that the heat generation member is in contact with the inner peripheral surface of the endless belt at a tension of 5 to 100 N.

The exemplary embodiment of the invention according to the item <10> provides the fixing device as set forth in the item <1>, wherein the first rotating member has a heat generation layer containing a non-magnetic metal material.

The exemplary embodiment of the invention according to the item <11> provides the fixing device as set forth in the item <1>, further including a support member for supporting the heat generation member at the ends thereof.

The exemplary embodiment of the invention according to the item <12> provides the fixing device including a non-magnetic metal member containing a non-magnetic metal material and provided in the inside of the first rotating member so as to be opposed to the magnetic field generation units across the first rotating member and the heat generation member without being brought into contact with the heat generation member.

The exemplary embodiment of the invention according to the items <14> provides an image-forming apparatus including: a latent image bearing member having a surface; latent image forming units for forming a latent image on the surface of the latent image bearing member; developing units for developing the latent image with an electrophotographic developer into a visual image; transfer units for transferring the developed visual image onto a transfer medium; and fixing units for fixing the visual image transferred onto the transfer medium, wherein the fixing units is the fixing device as set forth in any one of the items <1> to <13>.

Hereinbelow, an exemplary embodiment according to the invention will be described with reference to the accompanying drawings. It is to be noted that components having substantially the same function are denoted by the same reference numeral throughout the drawings, and the overlapping description thereof will be sometimes omitted.

Figure 2:
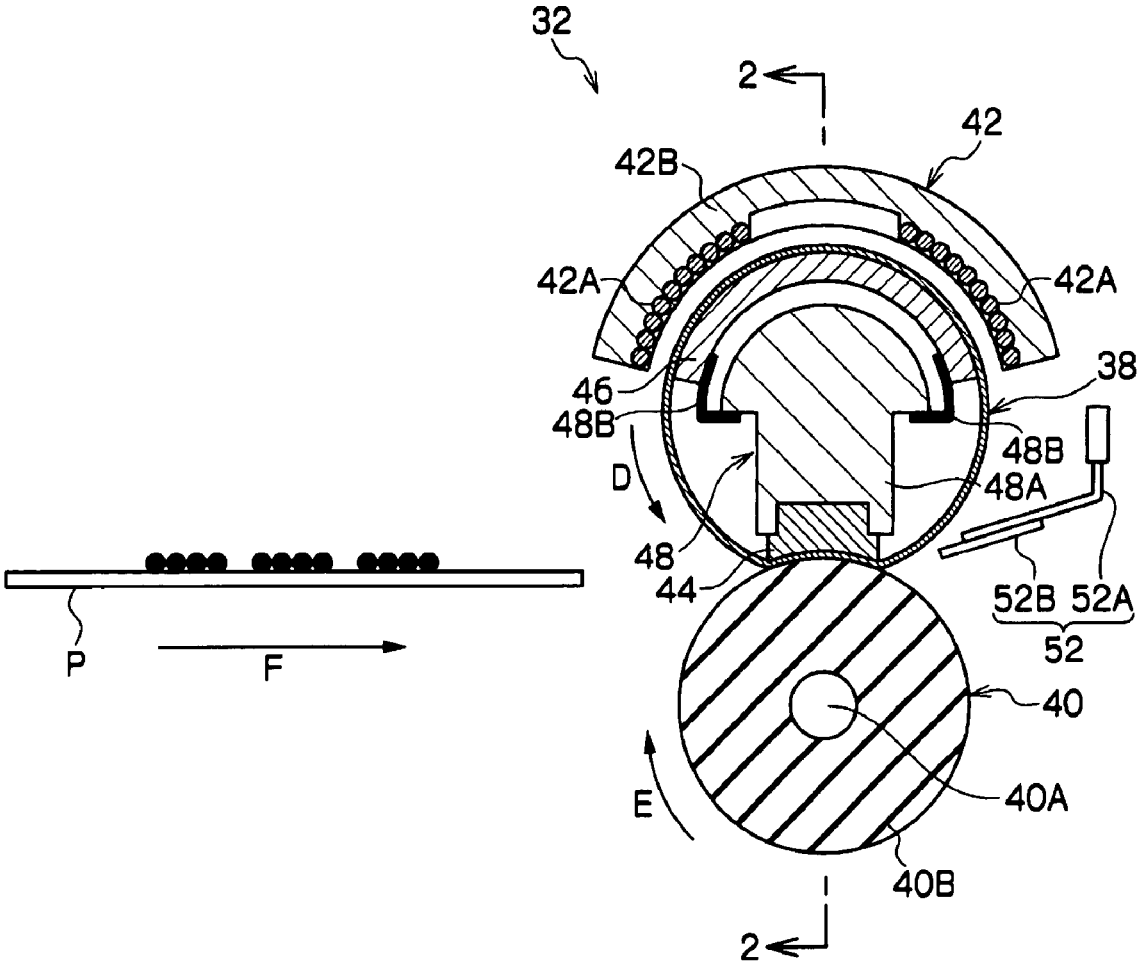
FIG. 2 is a schematic sectional view of a fixing device according to the exemplary embodiment of the invention.
Figure 3:
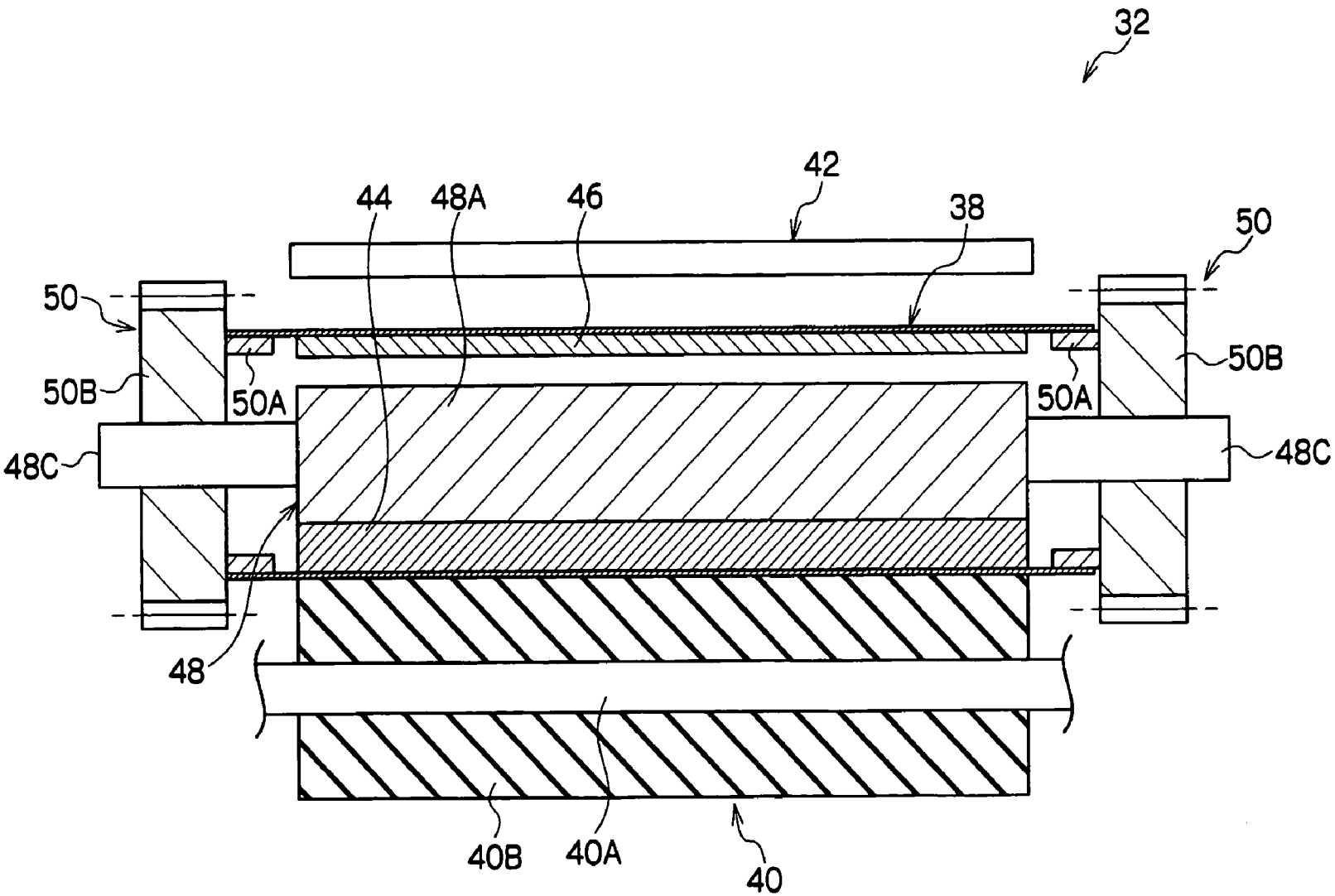
FIG. 3 is another schematic sectional view of the fixing device according to the exemplary embodiment of the invention.

FIG. 1 is a schematic diagram which shows the structure of an image-forming apparatus according to the exemplary embodiment of the invention, FIG. 2 is a schematic sectional view of a fixing device according to the exemplary embodiment of the invention, and FIG. 3 is another schematic sectional view of the fixing device according to the exemplary embodiment of the invention. It is to be noted that FIG. 2 is a schematic sectional view of a fixing device as viewed from the axial direction thereof, and FIG. 3 is a schematic sectional view taken along the 2-2 line shown in FIG. 2, that is, a schematic sectional view of the fixing device shown in FIG. 2 as viewed from a direction orthogonal to the axial direction of the fixing device.

As shown in FIG. 1, an image-forming apparatus 100 according to the exemplary embodiment of the invention includes a cylindrical photosensitive body 10 rotatable in one direction (i.e., a direction shown by the arrow A in FIG. 1). Around the photosensitive body 10, there are provided, from the upstream side to the downstream side in the rotation direction of the photosensitive body 10 in the following order, a charging device 12 for electrically charging the surface of the photosensitive body 10, an exposure device 14 for irradiating the surface of the photosensitive body 10 with image light L to form a latent image on the surface of the photosensitive body 10, a developing device 16 including developers 16A to 16D for selectively transferring a toner onto the latent image formed on the surface of the photosensitive body 10 to form a toner image, an endless belt-shaped intermediate transfer member 18 which has a peripheral surface rotatably supported and which is provided so as to be opposed to the photosensitive body 10, a cleaning device 20 for removing the toner remaining on the photosensitive body 10 after the completion of the transfer of the toner image, and a charge-eliminating exposure device 22 for eliminating electrical charge from the surface of the photosensitive body 10.

Inside the intermediate transfer member 18, there are provided a transfer device 24 for primarily transferring the toner image formed on the surface of the photosensitive body 10 onto the intermediate transfer member 18, two support rolls 26A and 26B, and a transfer counter roll 28 for secondary transfer. The intermediate transfer member 18 is stretched by these transfer device 24, support rolls 26A and 26B, and transfer counter roll 28 so as to be rotatable in one direction (i.e., a direction shown by the arrow B in FIG. 1). At a position opposite to the transfer counter roll 28 across the intermediate transfer member 18, there is provided a transfer roll 30 for secondarily transferring the toner image primarily transferred onto the outer peripheral surface of the intermediate transfer member 18 onto a recording sheet of paper (i.e., a recording medium) P. The recording sheet of paper P is fed into a pressure-contact portion between the transfer counter roll 28 and the transfer roll 30 in a direction shown by the arrow C in FIG. 1 to secondarily transfer the toner image onto the surface of the recording sheet of paper P at the pressure-contact portion, and is then further conveyed in the direction shown by the arrow C.

On the downstream side of the transfer roll 30 in a direction in which the recording sheet of paper P is conveyed (i.e., a direction shown by the arrow C), there is provided a fixing device 32 for thermally fusing the toner image transferred onto the surface of the recording sheet of paper P to fix it on the recording sheet of paper P. The recording sheet of paper P having the toner image is fed into the fixing device 32 via a paper guide member 36. Around the intermediate transfer member 18, a cleaning device 34 for removing the toner remaining on the surface of the intermediate transfer member 18 is provided downstream in the rotation direction of the intermediate transfer member 18 (i.e., a direction shown by the arrow B).

Hereinbelow, the fixing device according to the exemplary embodiment of the invention will be described.

As shown in FIGS. 2 and 3, the fixing device 32 according to the exemplary embodiment of the invention includes an endless fixing belt 38 (i.e., a first rotating member) rotatable in one direction (i.e., a direction shown by the arrow D in FIG. 2), a pressure roll 40 (i.e., a second rotating member) which is brought into contact with the peripheral surface of the fixing belt 38 and which is rotatable in one direction (i.e., a direction shown by the arrow E in FIG. 2), and a magnetic field generation device 42 (i.e., magnetic field generation units) provided at a distance from the outer peripheral surface of the fixing belt 38 located opposite to the pressure-contact surface between the fixing belt 38 and the pressure roll 40.

On the inner peripheral surface side of the fixing belt 38, there are provided a fixed member 44 forming a contact portion with the pressure roll 40, a heat generation member 46 provided so as to be in contact with the inner peripheral surface of the fixing belt 38 and to be opposed to the magnetic field generation device 42 across the fixing belt 38, and a support member 48 for supporting the fixed member 44. The heat generation member 46 is supported by the support member 48. On each side of the fixing belt 38, there is provided a driving force transmission member 50 for transmitting a rotation driving force to the fixing belt 38 to rotatably drive it.

On the downstream side of the contact portion between the fixing belt 38 and the pressure roll 40 in a direction in which the recording sheet of paper P is conveyed (i.e., a direction shown by the arrow F in FIG. 2), there is provided a release member 52. The release member 52 includes a support portion 52A whose one end is fixed and supported and a release sheet 52B supported by the support portion 52 A, and is provided in such a manner that the tip of the release sheet 52 B is adjacent to or in contact with the fixing belt 38.

First, the fixing belt 38 will be described. Examples of the fixing belt 38 include metal belts (i.e., belts made of metals such as stainless steel, soft magnetic materials (e.g., permalloy, sendust), and hard magnetic materials (e.g., Fe—Ni—Co alloys, Fe—Cr—Co alloys) having a thickness of, for example, 30 to 150 μm (preferably 50 to 150 μm, more preferably 100 to 150 μm), and resin belts (e.g., polyimide belts) having a thickness of, for example, 50 to 150 μm. Alternatively, belts obtained by forming a surface release layer (e.g., a fluoroplastic layer) having a thickness of, for example, 1 to 30 μm on the outer peripheral surface of any one of the above-mentioned metal belts and resin belts as a base material may also be used.

Particularly, the fixing belt 38 preferably has a heat generation layer containing a non-magnetic metal material which generates heat by itself by the action of a magnetic field. Specific examples of such a fixing belt include belts having a heat generation layer made of, for example, a metal (such as copper, aluminum, or silver) (e.g., the metal belt mentioned above) having a thickness of, for example, 2 to 20 μm (preferably 5 to 10 μm). Similarly to the above, this type of fixing belt 38 may also have a surface release layer (e.g., a fluoroplastic layer) having a thickness of, for example, 1 to 30 μm formed on the outer peripheral surface of the heat generation layer. Alternatively, the fixing belt 38 may be a belt obtained by sandwiching a heat generation layer between two base materials, more specifically a belt obtained by sandwiching a heat generation layer (e.g., copper) between, for example, two stainless steel base materials.

Between the base material and the surface release layer, an elastic layer containing silicone rubber, fluororubber, or fluorosilicone rubber may be provided.

Further, the heat capacity of the fixing belt 38 is preferably made small (e.g., 5 to 60 J/K, preferably 30 J/K or less) by, for example, reducing the thickness thereof or appropriately selecting a constituent material.

The diameter of the fixing belt 38 to be used is in a range of, for example, 20 to 50 mm. Further, a fluoroplastic-coated film having sliding durability may be provided on the inner peripheral surface of the fixing belt 38 (e.g., a film having sliding durability may be provided on only the fixed member 44), or the inner peripheral surface of the fixing belt 38 may be coated with, for example, a fluoroplastic, or a lubricant (e.g., a silicone oil) may be applied onto the inner peripheral surface of the fixing belt 38.

Figure 4:
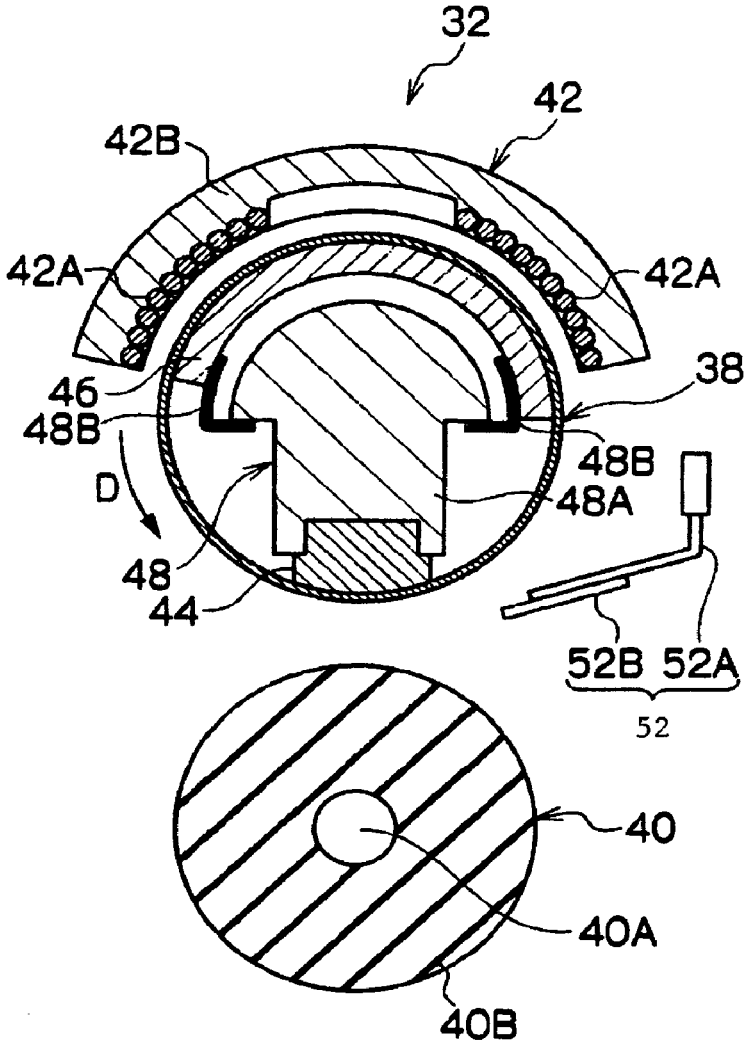
FIG. 4 is a schematic sectional view of the fixing device according to the exemplary embodiment of the invention in a state where a fixing belt and a pressure roll are separated from each other.

Next, the pressure roll 40 will be described. The pressure roll 40 is provided so as to be pressed by a spring member (not shown) provided on each side thereof against the fixing belt 38 and the fixed member 44 at a total load of, for example, 294 N (30 kgf). On the other hand, during preheating (i.e., during heating before reaching a fixable state), the pressure roll 40 is moved so as to be separated from the fixing belt 38 (see FIG. 4).

As the pressure roll 40, for example, a roll including a cylindrical core member 40A made of a metal and an elastic layer 40B (e.g., a silicone rubber layer, a fluororubber layer) provided on the surface of the core member 40 A can be used. If necessary, the pressure roll 40 may have a surface release layer (e.g., a fluoroplastic layer) on the outermost surface thereof.

Next, the heat generation member 46 will be described. The heat generation member 46 has a shape patterned after the inner peripheral surface of the fixing belt 38, and is provided so as to be opposed to the magnetic field generation device 42 across the fixing belt 38 and to be in contact with the inner peripheral surface of the fixing belt 38. The heat generation member 46 and spring members 48B of the support member 48 allow the fixing belt 38 to maintain its cylindrical shape without the heat generation member 46 being brought into contact with a support member main body 48A, and the heat generation member 46 is in substantial non-pressure contact with the inner peripheral surface of the fixing belt 38.

The heat generation member 46 generates heat by electromagnetic induction caused by the action of a magnetic field generated by the magnetic field generation device 42, and has a thickness larger than a skin depth, and contains a magnetic metal material.

The "skin depth" used herein is a skin depth δ (m) represented by the following formula: $\delta=503(\rho/(f\times\mu r))^{1/2}$, where f is a frequency (Hz) of a magnetic excitation circuit, μr is a relative magnetic permeability, and ρ is a specific resistance (Ωm).

The skin depth represented by the above formula refers to an absorption depth of an electromagnetic wave used for electromagnetic induction. The intensity of the electromagnetic wave in a portion deeper than the skin depth becomes 1/e or less. Conversely, almost all the energy is absorbed before reaching the skin depth.

Therefore, by setting the thickness of the heat generation member 46 to a value larger than the skin depth, it is possible to allow the heat generation member 46 to generate heat by the action of a magnetic field and to accumulate heat in the heat generation member 46 so that a reduction in the temperature hardly occurs.

Examples of the magnetic metal material include rare-earth metal-based magnetic materials containing neodymium (Nd)-iron (Fe)-boron (B) as main components; magnetic metal materials containing samarium (Sm)-cobalt (Co) as main components; alnico-based magnetic metal materials containing aluminum (Al)-nickel (Ni)-cobalt (Co) as main components; ferrite-based magnetic metal materials containing barium (Ba) or strontium (Sr) and ferric oxide ($Fe_2O_3$) as main components; soft magnetic materials; oxide soft magnetic materials; and magnetic shunt alloys.

The magnetic metal material is preferably a ferromagnetic material having, for example, a relative magnetic permeability of 100 or more, or about 100 or more, preferably 500 or more, or about 500 or more.

Alternatively, the magnetic metal material may be a temperature-sensitive magnetic metal material having a Curie point.

The Curie point of the magnetic metal material is preferably in a range of a preset temperature of the fixing belt 38 to a heat-resistant temperature of the fixing belt 38. More specifically, the Curie point is preferably in a range of, for example, 170 to 250° C., or about 170 to about 250° C., more preferably in a range of 190 to 230° C., or about 190 to about 230° C.

Preferred examples of the temperature-sensitive magnetic metal material include Ni—Fe-based magnetic shunt alloys and Ni—Cr—Fe-based magnetic shunt alloys.

The shape of the heat generation member 46 is not particularly limited as long as the thickness thereof is larger than the skin depth (more specifically, as long as the thickness thereof is in a range of, for example, about 0.05 to about 1.0 mm, preferably in a range of about 0.3 to about 0.6 mm). For example, the heat generation member 46 may have a shape obtained by cutting a portion having a predetermined central angle (e.g., 30 to 180°) out of a cylindrical member.

Next, the fixed member 44 will be described. The fixed member 44 is composed of, for example, a rod-shaped member having an axis in the axial direction (i.e., in the width direction) of the fixing belt 38, and can withstand a pressing force exerted by the pressure roll 40. The pressure roll 40 presses the fixing belt 38 against the fixed member 44 so that the fixing belt 38 is deformed toward the inner peripheral surface side thereof.

The material of the fixed member 44 is not particularly limited as long as the total amount of deflection of the fixed member 44 and the support member 48 at the time when a pressing force is exerted on the fixed member 44 by the pressure roll 40 is within an allowable level, more specifically in a range of about 0.5 mm or less. Examples of such a material include elastic materials such as silicone rubber and heat-resistant resins such as glass fiber-containing PPS (polyphenylenesulfide), phenol, polyimide, and liquid crystal polymer.

Next, the support member 48 will be described. The support member 48 includes, for example, a support member main body 48A, spring members 48B for supporting the heat generation member 46, and a shaft 48C provided at each end of the support member main body 48A in the longitudinal direction thereof.

Examples of a material for forming the support member main body 48A and the shaft 48C include metal materials and resin materials. In a case where the heat generation member 46 is made of the above-mentioned temperature-sensitive magnetic material, the support member main body 48A is preferably made of a non-magnetic metal material (e.g., copper, aluminum, silver) (non-magnetic material member).

The spring member 48B is a member for connecting the heat generation member 46 with the support member main body 48A, and directly supports the heat generation member 46. The spring member 48B is connected to the heat generation member 46 at each end in the width direction thereof.

The spring member 48B is formed from, for example, a bent leaf spring (made of, for example, a metal). The spring members 48B support the heat generation member 46, and even when the fixing belt 38 eccentrically rotates and therefore displaces in the direction of the radius thereof, the spring members 48B follow the displacement of the fixing belt 38 to allow the heat generation member 46 to be always in contact with the inner peripheral surface of the fixing belt 38.

Next, the driving force transmission member 50 will be described. The driving force transmission member 50 transmits a driving force to the fixing belt 38 for self-rotation thereof, and includes, for example, a flange portion 50A to be fitted into the inner side of the end of the fixing belt 38 and a cylindrical gear portion 50B whose outer peripheral surface has protrusions and depressions. Examples of a material for forming the driving force transmission member 50 include metal materials and resin materials.

The driving force transmission member 50 is supported by the end of the fixing belt 38 by fitting the flange portion 50A into the inner side of the end of the fixing belt 38. When the gear portion 50B of the driving force transmission member 50 is rotatably driven by, for example, a motor (not shown), the rotation driving force of the gear portion 50B is transmitted to the fixing belt 38, which allows the self-rotation of the fixing belt 38.

It is to be noted that, in this exemplary embodiment, the driving force transmission member 50 is provided at each end of the fixing belt 38 in the axial direction thereof, but is not particularly limited thereto. For example, the driving force transmission member 50 may be provided at only one end of the fixing belt 38 in the axial direction thereof. Further, in this exemplary embodiment, the driving force transmission member 50 is supported by the end of the fixing belt 38 by fitting the flange portion 50A into the inner side of the end of the fixing belt 38, but is not particularly limited thereto. For example, the driving force transmission member 50 may be supported by the end of the fixing belt 38 by fitting the end of the fixing belt 38 into the inner side of the flange portion 50A.

Next, the magnetic field generation device 42 will be described. The magnetic field generation device 42 has a shape patterned after the outer peripheral surface of the fixing belt 38, and is provided at a distance of, for example, 1 to 3 mm from the outer peripheral surface of the fixing belt 38 so as to be opposed to the heat generation member 46 across the fixing belt 38. Further, in the magnetic field generation device 42, there are provided exciting coils (i.e., magnetic field generation units) 42A, wound two or more times, along the axial direction of the fixing belt 38.

A magnetic excitation circuit (not shown) is connected to these exciting coils 42A to supply an alternating current thereto. On the surface of the exciting coils 42A, a magnetic member 42B is provided so as to extend along the length direction of the coils (i.e., along the axial direction of the fixing belt 38).

The magnetic field generation device 42 outputs a magnetic flux to the extent that the heat generation member 46 generates heat by the action of a magnetic flux (magnetic field) at, for example, lower than the Curie point of the heat generation member 46, more specifically at, for example, in a range of about 190 to about 230° C.

It is to be noted that the magnetic field generation device 42 may be provided on the inner peripheral surface side of the fixing belt 38 at a predetermined distance from the inner peripheral surface of the fixing belt 38. In this case, the heat generation member 46 is provided so as to be in contact with the outer peripheral surface of the fixing belt 38.

Hereinbelow, the operation of the image-forming apparatus 100 according to the exemplary embodiment of the invention will be described.

First, the surface of the photosensitive body 10 is electrically charged by the charging device 12, and is then irradiated with image light L emitted from the exposure device 14 to form a latent image thereon based on a difference in electrostatic potential. Then, the latent image is transported by the rotation of the photosensitive body 10 in a direction shown by the arrow A to a position opposite to one developer 16A of the developing device 16, and then a toner of a first color is transferred from the developer 16A to the latent image so that a toner image is formed on the surface of the photosensitive body 10. The toner image is transported by the rotation of the photosensitive body 10 in a direction shown by the arrow A to a position opposite to the intermediate transfer member 18, and is then electrostatically and primarily transferred onto the surface of the intermediate transfer member 18 by the transfer device 24.

On the other hand, the toner remaining on the surface of the photosensitive body 10 after the completion of the primary transfer of the toner image is removed by the cleaning device 20. The electric potential of the cleaned surface of the photosensitive body 10 is initialized by the charge-eliminating exposure device 22, and then the cleaned surface of the photosensitive body 10 is transported and again returned to a position opposite to the charging device 12.

Then, other three developers 16B, 16C, and, 16D of the developing device 16 are transported to a position opposite to the photosensitive body 10 one after another to form toner images of second, third, and fourth colors one after another in the same manner as in the case of the first color. After all the four toner images are superimposed on top of each other, they are transferred onto the surface of the intermediate transfer member 18 at one time.

The toner images superimposed on top of each other on the surface of the intermediate transfer member 18 are transported by the rotation of the intermediate transfer member 18 in a direction shown by the arrow B to a position opposite to both the transfer roll 30 and the transfer counter roll 28 so as to come in contact with a recording sheet of paper P fed into the contact portion between the transfer roll 30 and the transfer counter roll 28. A voltage for transfer is applied between the transfer roll 30 and the intermediate transfer member 18 so that the toner images are secondarily transferred onto the surface of the recording sheet of paper P.

The recording sheet of paper P having an unfixed toner image thereon is transported to the fixing device 32 via the paper guide member 36.

Next, the operation of the fixing device 32 according to the exemplary embodiment of the invention will be described.

First, at the same time as, for example, the beginning of operation for forming a toner image in the image-forming apparatus 100, the driving force transmission members 50 of the fixing device 32 are rotatably driven by a motor (not shown) with the fixing belt 38 and the pressure roll 40 being separated from each other (see FIG. 4) so that the fixing belt 38 is rotatably driven at a peripheral speed of, for example, 200 mm/sec in a direction shown by the arrow D (of course, these events do not need to occur at exactly the same tiunitd the same goes for the following).

At the same time as the beginning of rotation of the fixing belt 38, an alternating current is supplied from the magnetic excitation circuit (not shown) to the exciting coils 42A provided in the magnetic field generation device 42. When an alternating current is supplied to the exciting coils 42A, a magnetic flux (magnetic field) is repeatedly generated and dissipated around the exciting coils 42A. When this magnetic flux (magnetic field) crosses the heat generation member 46, an eddy current is generated in the heat generation member 46 so as to generate a magnetic field that obstructs a change in the magnetic field, and as a result, heat is generated in the heat generation member 46 in proportion to the square of the skin resistance of the heat generation member 46 and in proportion to the square of the magnitude of a current flowing through the heat generation member 46.

Here, in a case where the fixing belt 38 has a heat generation layer containing a non-magnetic metal material, a magnetic flux (magnetic field) penetrates the fixing belt 38, and therefore the heat generation layer generates heat by the action of the magnetic flux (magnetic field).

Then, the heat generation member 46 heats the fixing belt 38 while being rubbed against the inner peripheral surface of the fixing belt 38. As a result, the fixing belt 38 is heated to a preset temperature (e.g., 150° C.) in, for example, about 10 seconds.

Next, the pressure roll 40 is pressed against the fixing belt 38. The recording sheet of paper P conveyed to the fixing device 32 is fed into the contact portion between the fixing belt 38, heated by the heat generation member 46, and the pressure roll 40 to heat and press it by the fixing belt 38 and the pressure roll 40 so that the toner image is fused and pressure-fixed on the surface of the recording sheet of paper P.

As described above, during the fixing of the toner image by the fixing belt 38 and the pressure roll 40, since the heat generation member 46 has a thickness larger than the skin depth and contains a magnetic metal material, the heat generation member 46 can sufficiently generate and accumulate heat. Therefore, even when heat of the fixing belt 38 is consumed by the recording sheet of paper P passed through the contact portion between the fixing belt 38 and the pressure roll 40 for fixing the toner image thereon, the heat generation member 46 serves as a heat accumulation member and therefore heat is transported from the heat generation member 46 to the fixing belt 38.

Further, when the recording sheet of paper P having a size smaller than the width (i.e., a length in the axial direction) of fixable area of the fixing belt 38 is continuously fed into the contact portion between the fixing belt 38 and the pressure roll 40 for fixing, the heat of a paper passage area of the fixing belt 38 is consumed, whereas the heat of a paper non-passage area of the fixing belt 38 is not consumed. Therefore, the temperature of the paper non-passage area of the fixing belt 38 is increased.

On the other hand, in a case where the heat generation member 46 is made of the above-mentioned temperature-sensitive magnetic metal material, the temperature of a part of the heat generation member 46 which is brought into contact with the paper non-passage area of the fixing belt 38 having an increased temperature is also increased, and then when the temperature of the paper non-passage area of the fixing belt 38 becomes the Curie point or higher of the temperature-sensitive magnetic metal material constituting the heat generation member 46, the part of the heat generation member 46 overlapping (i.e., brought into contact with) the paper non-passage area of the fixing belt 38 becomes non-magnetic and therefore allows a magnetic flux (magnetic field) to penetrate it. In such a part of the heat generation member 46 where a magnetic flux (magnetic field) penetrates, the magnetic flux (magnetic field) is disturbed, thereby suppressing the generation of an eddy current and therefore reducing heat generation.

At this time, in a case where the support member main body 48A is composed of a non-magnetic metal material, the magnetic flux (magnetic field) reaches the support member main body 48A, and an eddy current mainly flows through the support member main body 48A, thereby further reducing an eddy current flowing through the fixing belt 38. Further, the magnetic flux (magnetic field) penetrating the heat generation member 46 is guided by the support member main body 48A composed of a non-magnetic metal material and then returned to the magnetic field generation device 42. Further, since the support member main body 48A is provided so as not to be in contact with the heat generation member 46, the heat of the fixing belt 38 is not transmitted to the support member main body 48A.

On the other hand, during the fixing of the toner image by the fixing belt 38 and the pressure roll 40, the fixing belt 38 is rotated while being brought into substantial non-pressure contact with and supported by the heat generation member 46 having a shape patterned after the shape of the inner peripheral surface of the fixing belt 38, and the heat generation member 46 reduces the sliding resistance of the fixing belt 38, absorbs the projections and depressions on the inner peripheral surface of the fixing belt 38, and receives an electromagnetic force (in a direction in which a magnetic field from the coils is obstructed), thereby allowing the fixing belt 38 to maintain its cylindrical shape to achieve fixing.

After the recording sheet of paper P is passed through the contact portion between the fixing belt 38 and the pressure roll 40, it tends to go straight in a direction in which the recording sheet of paper P is fed out of the contact portion due to its stiffness, and therefore the front end of the recording sheet of paper P is separated from the bending and rotating fixing belt 38. Then, the release member 52 (i.e., the release sheet 52B) is inserted between the front end of the recording sheet of paper P and the fixing belt 38 to separate the recording sheet of paper P from the surface of the fixing belt 38.

In such a way as described above, a toner image is formed and then fixed on a recording sheet of paper P.

TEST EXAMPLES

Hereinbelow, test examples of the fixing device according to the exemplary embodiment of the invention will be described.

Test Example 1

The fixing device according to the exemplary embodiment of the invention (see FIGS. 1 and 2) was evaluated in the following manner. The fixing belt, the pressure roll, the heat generation member, and the support member main body used are as follows.

Fixing belt: A belt having a diameter of 30 mm and composed of a base material made of stainless steel (SUS304) having a width of 360 mm and a thickness of 55 μm and a 30 μm-thick PFA (PFA: a copolymer of tetrafluoroethylene and perfluoroalkylvinylether) layer formed on the outer peripheral surface of the base material (heat resistant-temperature: about 250° C.).

Pressure roll: An elastic roll having a diameter of about 30 mm and a width of 350 mm and composed of a stainless steel shaft having a diameter of 20 mm, a 5 mm-thick elastic layer covering the shaft and made of silicone rubber (rubber hardness degree: 30°, JIS-A), and a 30 μm-thick PFA tube covering the elastic layer.

Heat generation member: A heat generation member formed from a curved plate obtained by cutting a portion having a central angle of 125° out of a cylindrical member having a thickness of 0.35 mm, a length of 310 mm, and a diameter of 30 mm and made of ferromagnetic carbon steel having a relative magnetic permeability of 500. It is to be noted that the skin depth of the heat generation member was 0.1 mm or less.

Support member main body: A support member main body made of aluminum.

(Evaluation)

Fixing of a toner image was continuously performed on 500 recording sheets of paper (size: B5, paper feed direction: one of the two shorter sides was regarded as a front end, copy speed: 35 sheets/min, basis weight: 110 gsm) under the conditions of an output of the magnetic field generation device of 1000 W, a preset temperature of 185° C., and a processing speed of 210 mm/s.

As a result, a preheating time required to increase the temperature of the fixing belt from room temperature to the preset temperature was 13 seconds. The temperature of a paper passage area of the fixing belt was decreased in the early stage of the subsequent continuous copying because the fixing belt was rapidly deprived of its heat by the paper, but a reduction in the surface temperature of the fixing belt was as small as 15° C. or less in the early stage of the continuous copying because heat energy was fed from the heat generation member to the fixing belt, thereby enabling copying at a speed of 35 sheets/min.

On the other hand, in a case where the heat generation member was not brought into contact with the inner peripheral surface of the fixing belt to prevent feeding of heat from the heat generation member, a reduction in the surface temperature of the fixing belt during the continuous copying was 40° C., and therefore copying could not be performed at a speed of 35 sheets/min. A maximum allowable reduction in the surface temperature of the fixing belt for performing copying was 20° C., and therefore in this case, the upper limit of the copying speed was 25 sheets/min.

Further, during the continuous copying, the temperature of the paper passage area of the fixing belt was maintained at 185° C., but the paper non-passage area of the fixing belt was not deprived of its heat by paper, and therefore the temperature of the paper non-passage area was rapidly increased and exceeded a heat-resistant temperature of 250° C. of the fixing belt after the continuous copying of about 100 sheets of paper. Therefore, the fixing device needed a time for making the temperature of the fixing belt uniform.

Test Example 2

Example Using a Heat Generation Member Made of a Temperature-Sensitive Magnetic Material Evaluation was made in the same manner as in the Test Example 1 except that the material of the heat generation member was replaced with an Ni—Fe-based ferromagnetic material (temperature-sensitive magnetic material) of magnetic shunt alloy having a relative magnetic permeability of 1000, a Curie point of 230° C., and a thickness of 0.6 mm.

As a result, a preheating time required to increase the temperature of the fixing belt from room temperature to the preset temperature was 15 seconds. The temperature of a paper passage area of the fixing belt was maintained at 185° C. during the subsequent continuous copying, but a paper non-passage area of the fixing belt was not deprived of its heat by paper, and therefore the temperature of the paper non-passage area was rapidly increased and then reached 225° C. after the continuous copying of about 40 sheets of paper. However, the temperature of a part of the heat generation member corresponding to the paper non-passage area reached the Curie point (Tc) thereof, that is, 230° C., and therefore a magnetic flux from the coils penetrated the magnetic shunt alloy and was then started to flow through the support member made of aluminum. As a result, an eddy current was started to flow through the aluminum support member having a low electrical resistance, thereby significantly reducing heat generation by the heat generation member. Thereafter, the temperature of the fixing belt was maintained at 225° C. As described above, by using such a heat generation member made of a temperature-sensitive magnetic metal material, it is possible to suppress the temperature rise of the paper non-passage area of the fixing belt during the continuous copying of small-sized sheets of paper.

Test Example 3

Example Using a Fixing Belt Having a Heat Generation Layer Containing a Non-Magnetic Metal Material Evaluation was made in the same manner as in the Test Example 1 except that the fixing belt was replaced with one composed of a 75 μm-thick polyimide belt as a base layer, a 10 μm-thick copper layer as a non-magnetic metal heat generation layer, and a 30 μm-thick PFA layer formed on the copper layer as a release layer.

As a result, a preheating time required to increase the temperature of the fixing belt from room temperature to the preset temperature was 11 seconds which was shorter than that of the Test Example 1 by about 2 seconds. This is because the fixing belt itself generated heat and the heat capacity of the fixing belt was smaller than that of the Test Example 1. The fixing belt was rapidly deprived of its heat by paper in the early stage of the continuous copying, and therefore the temperature of a paper passage area of the fixing belt was decreased, but a reduction in the surface temperature of the fixing belt in the early stage of the continuous copying was as small as 8° C. or less because heat energy was fed to the fixing belt from the heat generation member. In a case where continuous copying was performed at a speed of 40 sheets/min, a reduction in the surface temperature of the fixing belt in the early stage of the continuous copying was 14° C. which was substantially the same as that of the Test Example 1. During the subsequent continuous copying, the temperature of the paper passage area of the fixing belt was maintained at 185° C., but a paper non-passage area of the fixing belt was not deprived of its heat by paper and therefore the temperature of the paper non-passage area was rapidly increased and then exceeded a heat-resistant temperature of 250° C. of the fixing belt after the continuous copying of about 100 sheets of paper. Therefore, the fixing device needed a time for making the temperature of the fixing belt uniform.

Comparative Example 1

Example Using a Heat Generation Member Having a Thickness of a Skin Depth or Less Evaluation was performed in the same manner as in the Test Example 1 except that the thickness of the heat generation member was changed to 0.05 mm.

As a result, much of the magnetic flux from the coils penetrated the heat generation member and started to flow through the aluminum support member, and therefore an eddy current was started to flow through the aluminum support member having a small electrical resistance, thereby significantly reducing heat generation by the heat generation member. From the result, it has been found that it is impossible to apply an electric power of 400 W or more to the heat generation member, more specifically when electric power larger than 400 W is attempted to obtain, the load on a power source becomes too large to exceed the breakdown voltage of a switching element, and therefore it is impossible to apply a required electric power of 1000 W to the heat generation member.

As can be seen from the above-described results of the Test Examples and Comparative Example, the fixing devices of the Test Examples according to the exemplary embodiment of the invention have a shorter preheating time and enable higher-speed fixing as compared to the fixing device of the Comparative Example because a reduction in the temperature of the rotating member caused by the passage of paper is suppressed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical application, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a first cylindrical rotating member having an inner peripheral surface and an outer peripheral surface;

a second rotating member that contacts the first rotating member;

a magnetic field generation unit that generates a magnetic field, the magnetic field generation unit being provided at a predetermined distance from the inner or outer peripheral surface of the first rotating member;

a heat generation member that generates heat by a magnetic field, the heat generation member being provided so as to oppose the magnetic field generation unit across the first rotating member and to contact the first rotating member, and having a thickness larger than a skin depth and containing a magnetic metal material; and a non-magnetic metal member containing a non-magnetic metal material, the non-magnetic metal member being provided at the inside of the first rotating member so as to oppose the magnetic field generation unit across the first rotating member and the heat generation member without contacting the heat generation member.

2. The fixing device according to claim 1, wherein the skin depth is a skin depth δ (m) represented by the following formula:

$$\delta=503(\rho/(f\times\mu r))^{1/2}$$

wherein f is a frequency f (Hz) of a magnetic excitation circuit, μr is a relative magnetic permeability, and ρ is a specific resistance (Ωm).

3. The fixing device, according to claim 1, wherein the magnetic metal material has a relative magnetic permeability of about 100 or more.

4. The fixing device according to claim 1, wherein the magnetic metal material is a temperature-sensitive magnetic metal material having a Curie point.

5. The fixing device according to claim 4, wherein the Curie point is within a range from a preset temperature of the first rotating member to a heat-resistant temperature of the first rotating member.

6. The fixing device according to claim 4, wherein the Curie point is within a range of from about 170 to about 250° C.

7. The fixing device according to claim 4, wherein the temperature-sensitive magnetic material is a Ni—Fe-based magnetic shunt alloy or a Ni—Cr—Fe-based magnetic shunt alloy.

8. The fixing device according to claim 1, further comprising a driving force transmission member for transmitting a rotation driving force to the first rotating member, the driving force transmission member being provided at least at one end of the first rotating member in an axial direction thereof.

9. The fixing device according to claim 1, wherein the first rotating member is configured by an endless belt, the magnetic field generation unit is provided at a predetermined distance from the outer peripheral surface of the first rotating member, and the heat generation member allows the first rotating member to maintain its cylindrical shape and is in substantial non-pressure contact with the inner peripheral surface of the first rotating member.

10. The fixing device according to claim 1, wherein the first rotating member has a heat generation layer containing a non-magnetic metal material.

11. The fixing device according to claim 1, further comprising a support member for supporting the heat generation member at ends thereof.

12. The fixing device according to claim 1, wherein the non-magnetic metal material is a metal selected from the group consisting of copper, aluminum and gold.

13. An image-forming apparatus comprising:

a latent image supporter having a surface;

a latent image forming unit for forming a latent image on the surface of the latent image supporter;

a developing unit for developing the latent image into a visible image with an electrophotographic developer;

a transfer unit for transferring the developed visible image onto a transfer medium; and a fixing unit for fixing the visible image that is transferred onto the transfer medium, the fixing units comprising:

a first cylindrical rotating member having an inner peripheral surface and an outer peripheral surface;

a second rotating member that contacts the first rotating member;

a magnetic field generation unit that generates a magnetic field, the magnetic field generation unit being provided at a predetermined distance from the inner or outer peripheral surface of the first rotating member;

a heat generation member that generates heat by a magnetic field, the heat generation member being provided so as to oppose the magnetic field generation unit across the first rotating member and to contact the first rotating member, and having a thickness larger than skin depth and containing a magnetic metal material; and a non-magnetic metal member containing a non-magnetic metal material, the non-magnetic metal member being provided at the inside of the first rotating member so as to oppose the magnetic field generation unit across the first rotating member and the heat generation member without contacting the heat generation member; wherein the first rotating member being configured by an endless belt, the magnetic field generation unit being provided at a predetermined distance from the outer peripheral surface of the first rotating member, and the heat generation member allowing the first rotating member to maintain its cylindrical shape and is in substantial non-pressure contact with the inner peripheral surface of the first rotating member.

14. An image-forming apparatus comprising:

a latent image supporter having a surface;

a latent image forming unit for forming a latent image on the surface of the latent image supporter;

a developing unit for developing the latent image into a visible image with an electrophotographic developer;

a transfer unit for transferring the developed visible image onto a transfer medium; and a fixing unit for fixing the visible image that is transferred onto the transfer medium, the fixing units comprising:

a first cylindrical rotating member having an inner peripheral surface and an outer peripheral surface;

a second rotating member that contacts the first rotating member;

a magnetic field generation unit that generates a magnetic field, the magnetic field generation unit being provided at a predetermined distance from the inner or outer peripheral surface of the first rotating member;

a heat generation member that generates heat by a magnetic field, the heat generation member being provided so as to oppose the magnetic field generation unit across the first rotating member and to contact the first rotating member, and having a thickness larger than a skin depth and containing a magnetic metal material; and a non-magnetic metal member containing a non-magnetic metal material, the non-magnetic metal member being provided at the inside of the first rotating member so as to oppose the magnetic field generation unit across the first rotating member and the heat generation member without contacting the heat generation member.

* * * * *